US007565756B2

(12) United States Patent
Almadani

(10) Patent No.: US 7,565,756 B2
(45) Date of Patent: Jul. 28, 2009

(54) LOST MOTION MECHANISM FOR MOVABLE VEHICLE IMPLEMENTS

(75) Inventor: Mazen W. Almadani, Woodbury, MN (US)

(73) Assignee: Parker-Hannifin Corporation, Cleveland, OH (US)

( * ) Notice: Subject to any disclaimer, the term of this patent is extended or adjusted under 35 U.S.C. 154(b) by 0 days.

(21) Appl. No.: 11/713,431

(22) Filed: Mar. 2, 2007

(65) Prior Publication Data

US 2007/0214683 A1 Sep. 20, 2007

Related U.S. Application Data

(60) Provisional application No. 60/778,684, filed on Mar. 3, 2006.

(51) Int. Cl.
*E01H 5/04* (2006.01)

(52) U.S. Cl. ..... 37/232; 37/236

(58) Field of Classification Search ..... 37/232, 37/236, 234, 235; 172/816, 819
See application file for complete search history.

(56) References Cited

U.S. PATENT DOCUMENTS 2,694,267 A * 11/1954 Donnelly et al. ..... 37/232
2,841,894 A * 7/1958 Valois ..... 37/236
3,014,289 A * 12/1961 Torrey ..... 37/233
3,432,949 A * 3/1969 Glesmann ..... 37/231
3,949,892 A * 4/1976 Ohms ..... 414/635
4,028,820 A 6/1977 Simonds, Jr.
4,031,966 A * 6/1977 Farrell ..... 172/794
4,096,652 A * 6/1978 Raines et al. ..... 37/231
4,307,523 A * 12/1981 Reissinger et al. ..... 37/233
4,357,766 A * 11/1982 Croteau et al. ..... 37/281
4,439,939 A 4/1984 Blau
4,462,172 A 7/1984 Caron
4,843,744 A * 7/1989 Jansen ..... 37/232
4,999,935 A 3/1991 Simi et al.
5,044,098 A * 9/1991 Berghefer ..... 37/232
5,082,065 A 1/1992 Fletcher
5,109,618 A * 5/1992 Grubler et al. ..... 37/232
5,129,755 A * 7/1992 Dickson ..... 404/90
5,191,729 A * 3/1993 Verseef ..... 37/232
5,195,261 A 3/1993 Vachon
5,240,129 A * 8/1993 Schrick et al. ..... 212/175
5,720,122 A * 2/1998 McLellan ..... 37/233
5,894,688 A 4/1999 Struck et al.
6,088,937 A * 7/2000 DiClementi et al. ..... 37/232
6,163,985 A 12/2000 Chinnery et al.
6,253,470 B1 7/2001 Depies et al.
6,256,909 B1 7/2001 Kost et al.
6,467,199 B1 10/2002 Christy (Continued)

*Primary Examiner*—Thomas A Beach
(74) *Attorney, Agent, or Firm*—Daniel J. Whitman

(57) ABSTRACT

A lost motion mechanism that is operatively interconnected with a hydraulic cylinder is provided. The lost motion mechanism includes an elongated rod connected with a portion of the hydraulic cylinder. An elongated sleeve member is adapted to receive at least a portion of the rod extension. The sleeve member includes at least one slot of a predetermined length. At least one pin member is attached relative to the rod extension and protrudes into the at least one slot. The pin member together with the slot limits the longitudinal movement of the rod extension and enables an implement to be moved by hydraulic force both upward and downward relative to ground level as well as enables the implement to be free floating relative to the ground level.

17 Claims, 8 Drawing Sheets

U.S. PATENT DOCUMENTS 6,581,306 B1 * 6/2003 DiClementi et al. ..... 37/231
6,640,468 B2 11/2003 Menze
6,928,757 B2 8/2005 Bloxdorf et al.
7,028,423 B1 * 4/2006 Curry ..... 37/236
7,063,169 B2 6/2006 Elliott
2005/0144814 A1 7/2005 Potak

* cited by examiner

LOST MOTION MECHANISM FOR MOVABLE VEHICLE IMPLEMENTS

CROSS REFERENCE TO RELATED APPLICATIONS

The present application claims the benefit of the filing date of U.S. Provisional Patent Application Ser. No. 60/778,684, filed Mar. 3, 2006, the disclosure of which is incorporated herein by reference.

FIELD OF THE INVENTION

The present invention pertains to an apparatus for moving, relative to ground level, of a mounted implement on a vehicle. More particularly, the invention pertains to the operative interpositioning of a lost motion mechanism between a piston rod output end and either the vehicle or the implement, thereby permitting full lowering the implement to the ground level in a floating condition without fluid-power forces acting thereon.

BACKGROUND OF THE INVENTION

Most of the current plow constructions used on vehicles, such as, e.g. ATV (All-Terrain Vehicles) utilize one of two different structures and methods for actuating the scraper blades on snowplow systems. The first structure and method of operation utilizes a winch to raise and lower the blade, with the blade typically being located at such an angle so as to cause the winch cable to readily chafe. As a result of the chafing, the winch cable may wear prematurely, and, thus, necessitating frequent replacement, particularly when used in commercial and municipal markets. In addition, these plow constructions also do not include the ability to change the blade angle unless the operator physically gets off the vehicle in order to manually change same. The second structure and method of operation utilizes electric actuators to raise and lower the blade.

These constructions only have the ability to exert a down force on the blade and include no mechanisms that would permit the blade to "float" during operation. While some other constructions have the actuator attached to a chain that will allow the blade to float at full extension, the chain eliminates the ability to exert the noted down force. While some further plow constructions use hydraulic power unit systems, these constructions are not designed to withstand an impact if the operator impinges on an object with the plow blade.

The patent literature includes large numbers of mechanism, devices, as well as operating systems pertaining to pivoting front-end mounted implements for vehicles. The literature includes: U.S. Pat. No. 7,063,169 B2 to Elliott; U.S. Pat. No. 6,928,757 B2 to Bloxdorf et al.; U.S. Pat. No. 6,640,468 Be to Menze; U.S. Pat. No. 6,467,199 B1 to Christy; U.S. Pat. No. 6,246,909 B1 to Kost et al.; U.S. Pat. No. 6,253,470 B1 to Dopies et al.; U.S. Pat. No. 6,163,985 to Chinnery et al.; U.S. Pat. No. 5,894,688 to Struck et al.; U.S. Pat. No. 5,195,261 to Vachon; U.S. Pat. No. 5,082,065 to Landoll et al.; U.S. Pat. No. 4,999,939 to Blau; U.S. Pat. No. 4,028,820 to Simonds, Jr.; and U.S. Patent Publication No. 2005/0144814 to Potak. However, none of these disclose structures that pertain to a lost motion mechanism for movable vehicle implements that includes the features and advantages of the present invention.

SUMMARY OF THE INVENTION

In order to overcome the deficiencies of the prior art devices, a lost motion mechanism is provided. The lost motion mechanism is operatively interconnected with a hydraulic cylinder. The hydraulic cylinder is rotatably connected to one of a vehicle and an implement. The lost motion mechanism is rotatably connected to the other of the vehicle and the implement. The cylinder and lost motion mechanism cooperate for moving the implement relative to a ground level. The lost motion mechanism comprises in combination: an elongated rod connected with a portion of the hydraulic cylinder; an elongated sleeve member adapted to receive at least a portion of the rod extension, the sleeve member including at least one slot of a predetermined length; and at least one pin member attached relative to the rod extension and protruding into the at least one slot. The pin member together with the slot, limiting the longitudinal movement of the rod extension and enabling the implement to be moved by hydraulic force both upward and downward relative to the ground level as well as enabling the implement to be free floating relative to the ground level.

In one version of the lost motion mechanism, the sleeve member includes at least two slots. The at least one pin member extends into each slot.

In another version of the lost motion mechanism, the slots are equally peripherally spaced about a circumference of the sleeve member.

In yet a further version of the lost motion mechanism, the degree of floating movement of the implement is determined by a length of the slot.

In yet another version of the lost motion mechanism, the rotatable connections are achieved via clevis coupling members.

In still a differing version of the lost motion mechanism, the implement takes the form of a snow plow.

In another embodiment, an apparatus is provided for moving, relative to ground level, an implement of a vehicle utilizing a hydraulic cylinder. The hydraulic cylinder being rotatably connected to one of the vehicle and the implement. The improvement comprises a lost motion mechanism interposed between the hydraulic cylinder and the other of the vehicle and the implement. The lost motion mechanism enabling lowering of the implement under full hydraulic pressure as well as full raising of the implement. The lost motion mechanism additionally permits full lowering of the implement, relative to the ground level, in a floating condition without hydraulic forces acting thereon.

In yet another embodiment, an apparatus is provided for moving, relative to ground level, of a front-end mounted snow plow on a vehicle utilizing a fluid power cylinder. The cylinder is rotatably connected to one of the vehicle and the snow plow. The improvement comprises a mechanical lost motion mechanism interposed between the cylinder and the other of the vehicle and the snow plow. The lost motion mechanism permits full lowering of the snow plow, relative to the ground level, in a floating condition without fluid power forces acting thereon.

DETAILED DESCRIPTION OF THE INVENTION

Figure 1:
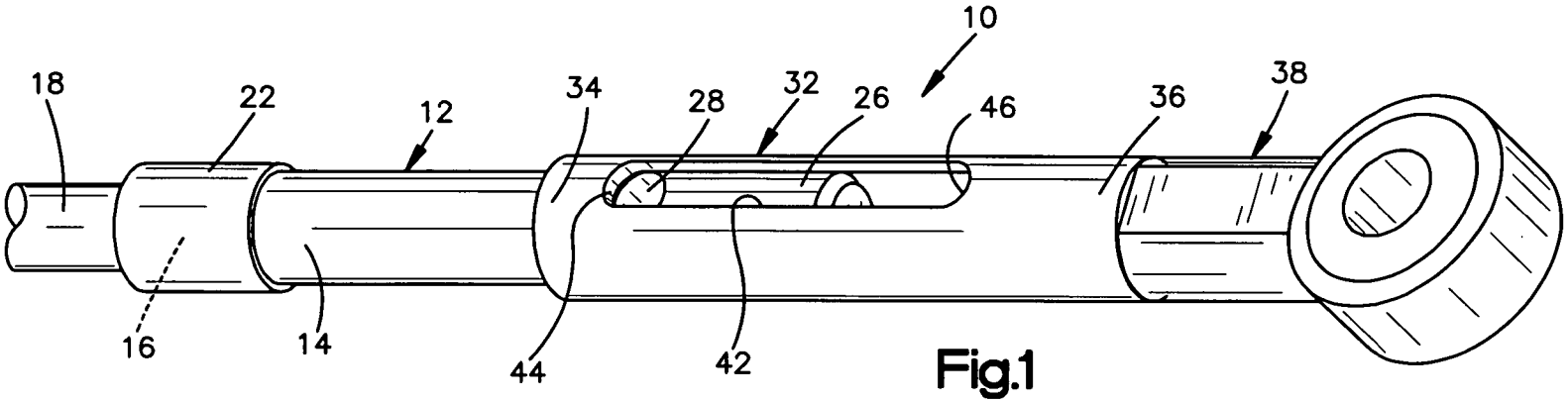
FIG. 1 is a perspective view of the lost motion mechanism of the present invention in a fully retracted position A.
Figure 2:
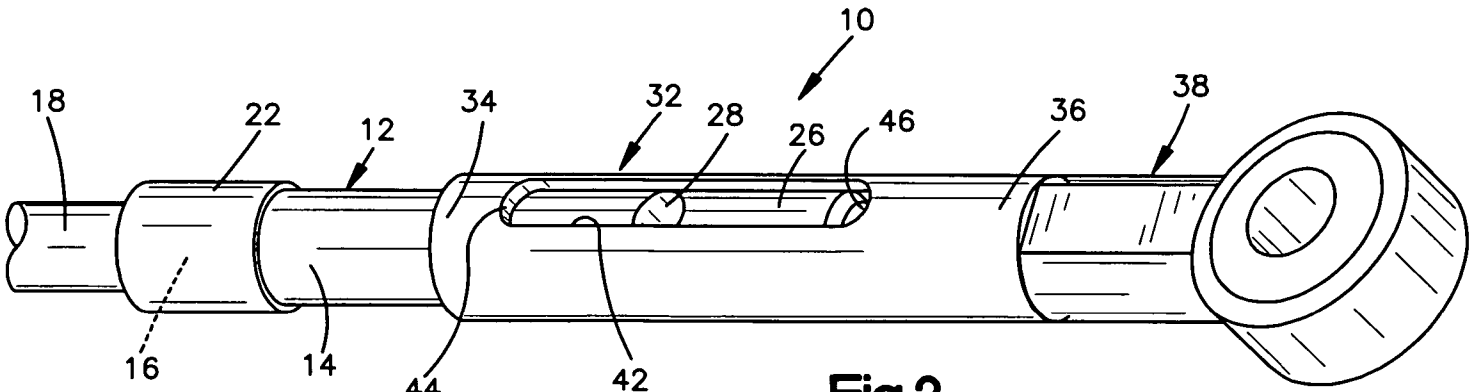
FIG. 2 is an enlarged perspective view similar to that of FIG. 1, but showing the lost motion device or mechanism in a free floating, intermediate, position B.
Figure 3:
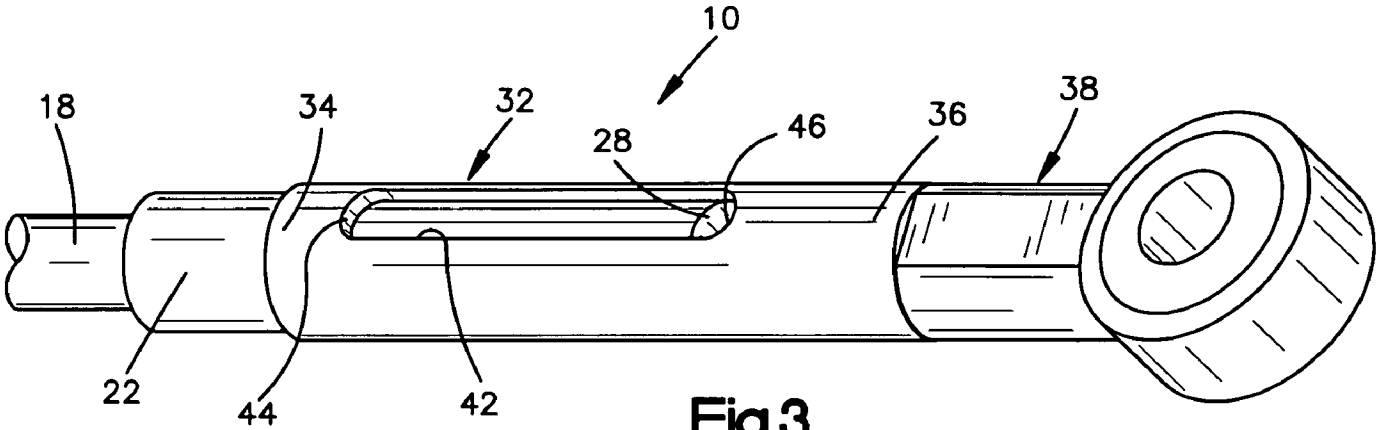
FIG. 3 is a slightly enlarged perspective view, again similar to that of FIG. 1, but showing the lost motion device in a fully extended position C.

Referring now to the several drawings, illustrated in FIGS. 1-3 are similar perspective views of the lost motion device (LMD) or mechanism 10 of this invention, but showing same in three differing positions. FIG. 1 shows lost motion mechanism 10 in a fully extended position A, while FIG. 2 shows LMD 10 in an intermediate, floating, position B, with FIG. 3 showing LMD 10 in a fully retracted position C.

Turning first to FIG. 1 and fully extended position A, LMD 10 includes an elongated rod extension 12 affixed on an inner end 14 thereof, to the outer end 16 of the piston rod or output member 18 of a double-acting hydraulic cylinder 20 (FIGS. 5-11). This affixation may, for example, take the form of an internally-threaded, increased diameter, rod inner end portion of piston rod outer end 16. Rod extension 12 also includes at a predetermined distance from an outer end 26 thereof, a lateral bore or through hole 28, perpendicular to the axial extent of rod extension 12.

Figure 7:
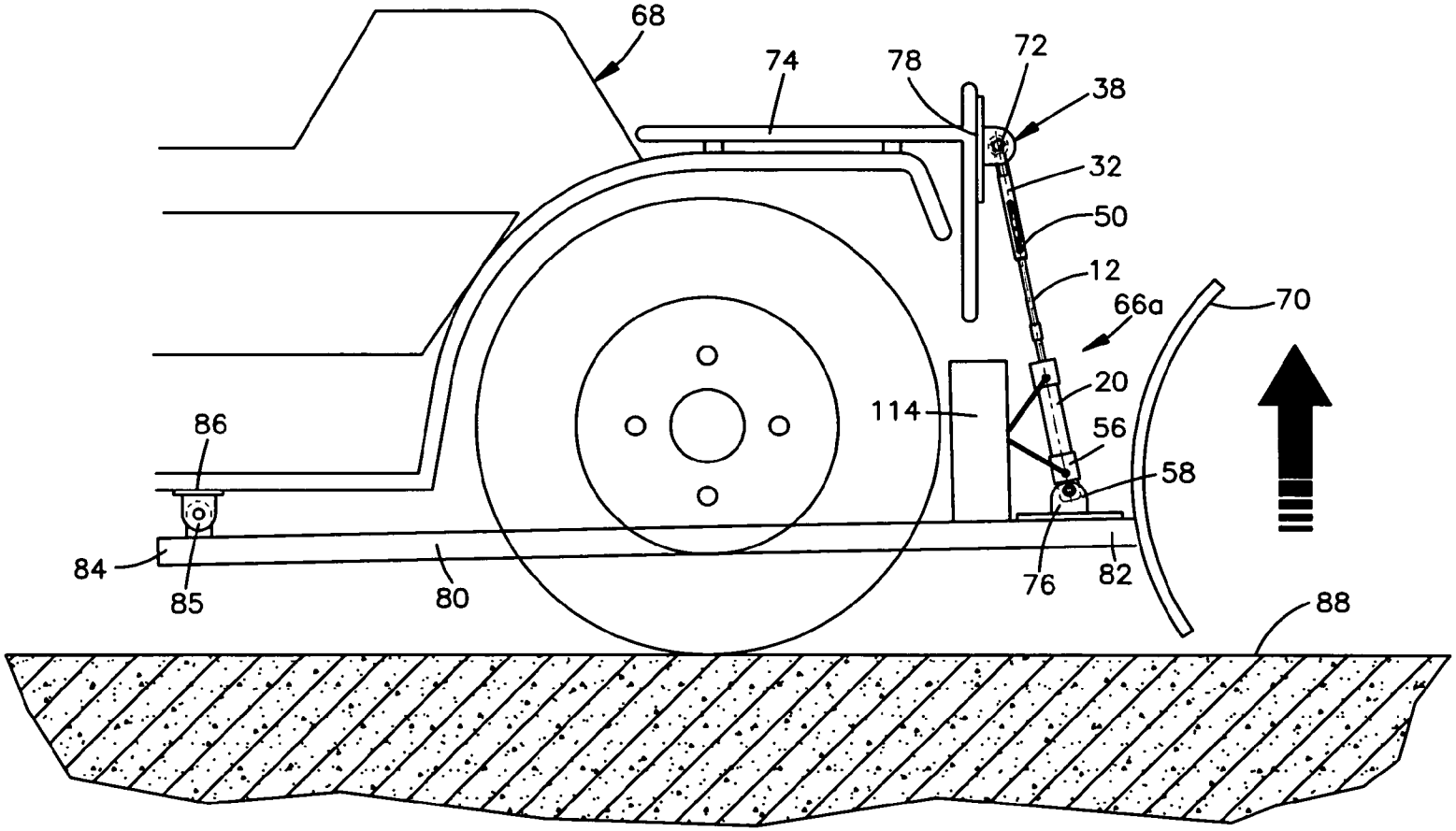
FIG. 7 is a schematic side view of a vehicle equipped with a pivoting implement wherein the lost motion device is in a fully retracted position A.

As best seen in the fully retracted position C illustrated in FIG. 3, an elongated sleeve member 32 is configured or adapted to slidingly receive therein, via an open inner end 34 thereof, the full axial extent of rod extension 12, except for increased diameter rod inner end portion 22, which in this position abuts sleeve member inner end 34. Elongated sleeve member 32, at an open outer end 36 is provided, e.g. via complementary threadings (FIG. 5), with any desired axially-extending coupling member 38, such as a conventional clevis coupling, for operative connection to an implement 70 (FIG. 7). Sleeve member 32 is also provided with at least one, but preferably two radially or circumferentially opposed axially-extending, straight, land-locked slots or grooves 42 of a predetermined length, terminating at an inner end 44 and at an outer end 46.

Figure 4:
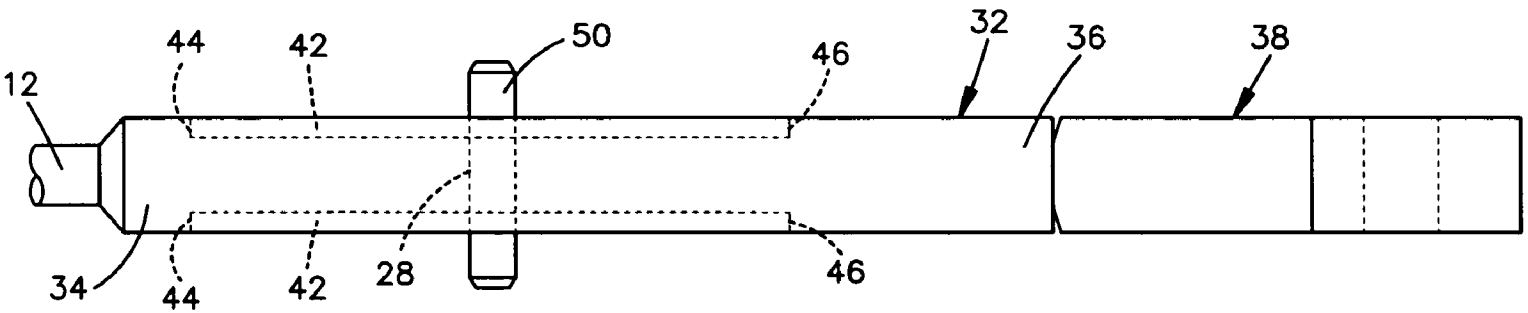
FIG. 4 is a simplified plan view of FIG. 2, showing the addition of a lateral arresting pin to the structure thereof.

In order to restrict the extent of the axial sliding movement of rod extension 12, within sleeve member 32, as best illustrated in FIGS. 4-11, a pin member 50, preferably secured as via press-fitting in rod extension through hole 28, extends into and through at least one of circumferentially opposed sleeve member slots 42, with pin member(s) 50 forcibly abutting sleeve member slot inner end 44 in position A of FIG. 1; forcibly abutting sleeve member slot outer end 46 in position C of FIG. 3; and being freely floating in a position intermediate slot ends 44 and 46 in position B of FIGS. 2 and 4.

Figure 5:
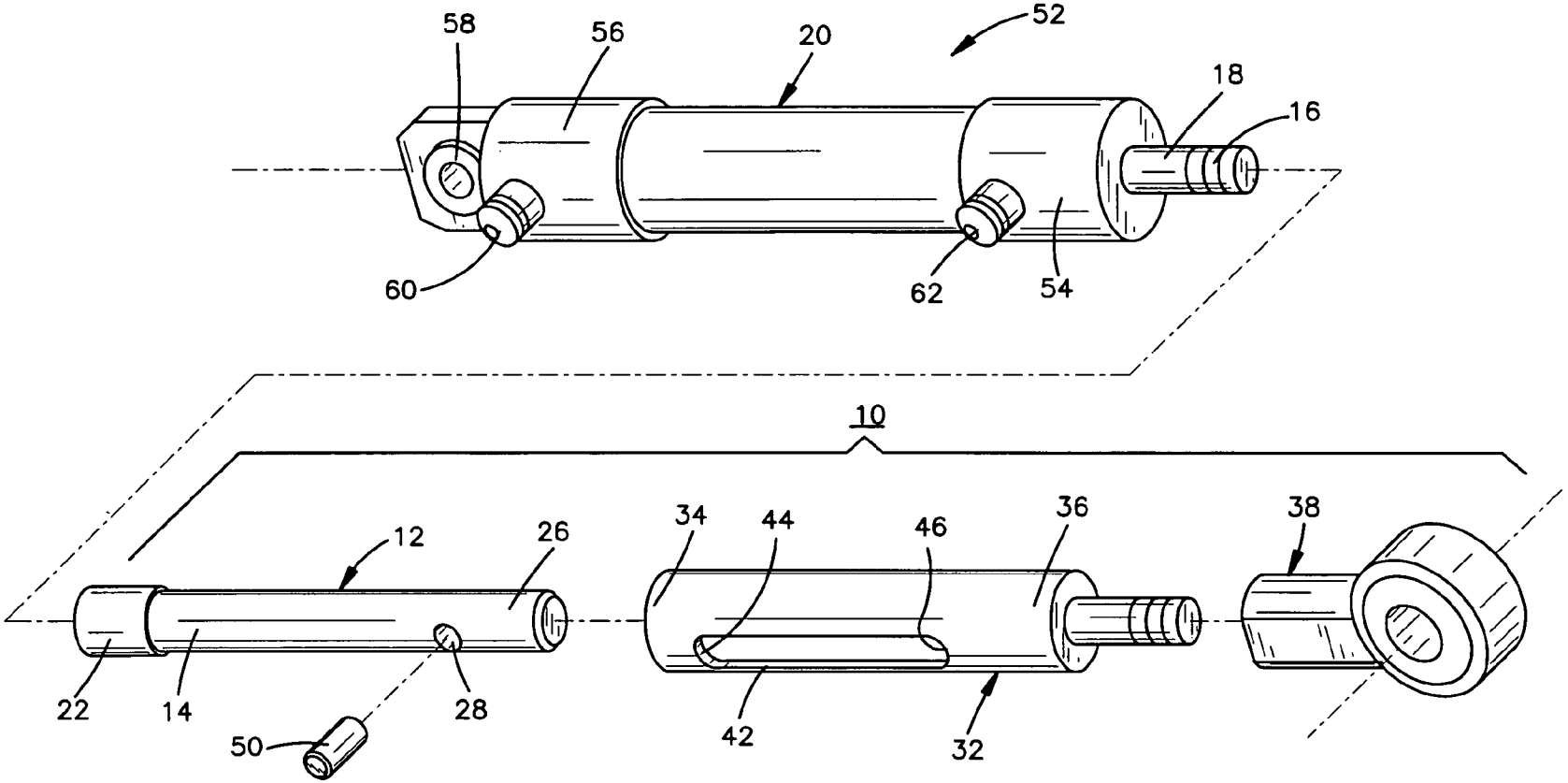
FIG. 5 is an exploded perspective view of the lost motion mechanism of FIGS. 1-4 and a double-acting hydraulic cylinder with which the former is adapted to be coupled.

FIG. 5 illustrates an exploded view of LMD 10 of FIGS. 1-4 together with double acting hydraulic cylinder 20, with increased diameter rod outer end 16, as already previously described. In addition, FIG. 5 also clearly illustrates that sleeve member 32 is adapted to e.g., be secured to coupling member 38 via complementary threadings. Double acting hydraulic cylinder 20 may take the form of a conventional unit and includes a cylinder housing 52, having an apertured end cap 54, through which piston rod 18 extends, as well as a closed end cap 56 having a known integral clevis-type coupling member 58. Pressurized hydraulic fluid alternately enters and exhausts from reversible ports 60 and 62, depending upon the flow direction of the hydraulic fluid, in a manner well known in the art.

Figure 6A:
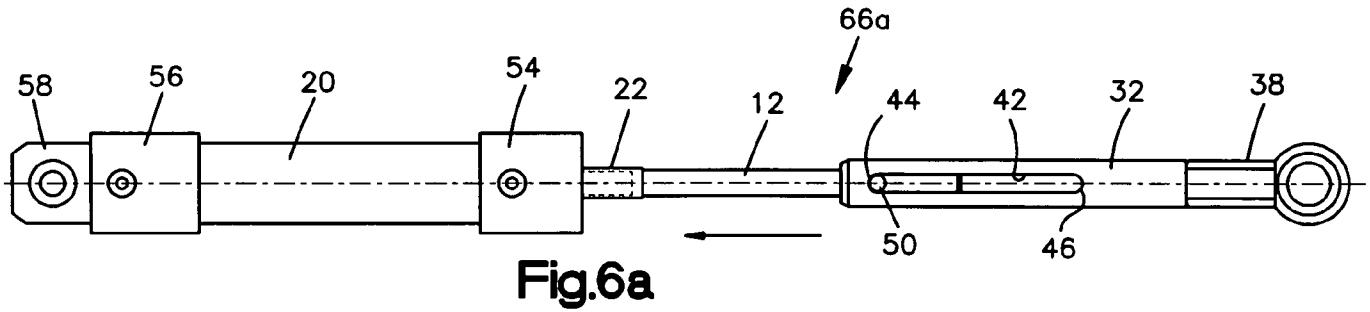
FIG. 6*a* is a side view of the lost motion mechanism/hydraulic cylinder assembly in the fully retracted position A.
Figure 6B:
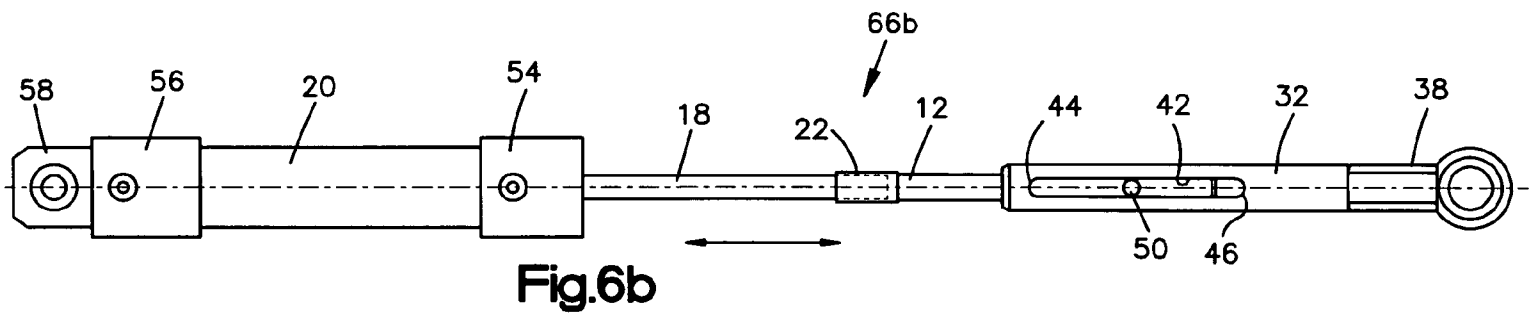
FIG. 6*b* is a view similar to that of FIG. 6*a,* but showing same in a free floating, intermediate, position B.
Figure 6C:
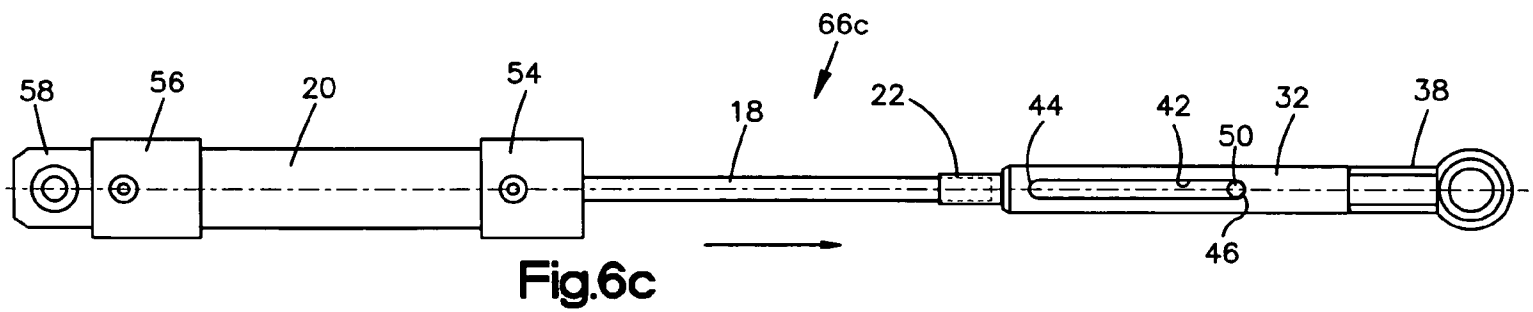
FIG. 6*c* is a view again similar that that of FIG. 6*a,* but showing same in a fully extended, position C.

Continuing now with FIGS. 6*a*-6*c,* FIG. 6*a* further illustrates the combination 66 of LMD 10 and double acting cylinder 20. In FIG. 6*a,* combination 66 is labeled 66*a,* since it illustrates the LMD/hydraulic cylinder combination in the fully retracted position A, wherein rod extension pin member 50, substantially abuts inner end 44 of land-locked slots 42 and piston rod increased diameter end portion 22, substantially abuts apertured cylinder end cap 54. In the position of FIG. 6*a,* the piston rod 18 (not shown in FIG. 6*a*) is nearly or fully retracted. The position of combination 66*a,* shown in FIG. 6*a,* is also the position shown in FIG. 7 in which combination 66 is interposed between a vehicle 68 and an implement 70.

In FIG. 7, sleeve member coupling member 38 is rotatably attached to a pin member or mounting 72 affixed to an upper support structure 74 of vehicle 68 at 78. Similarly, clevis-type coupling 58 of cylinder 20 is rotatably attached or affixed to a pin member or mounting 76 affixed to one end 82 to an implement support frame 80, with another end 84 being pivotally attached or affixed at 86, to the chassis of vehicle 68 via a pin member or mounting 85. Thus, by virtue of the actuation of combination 66, implement 70 can be pivoted relative to ground level 88. It should be understood that the mounting position or orientation of combination 66*a,* as best seen in FIG. 7, could, if so desired, be inverted by rotatably mounting coupling 58 to support structure 74 and rotatably mounting sleeve coupling member 38 at support frame end 82. As already noted, position A of FIG. 7 illustrates implement 70 in the fully retracted position A, similar to the corresponding position A showings in FIGS. 1 and 6*a*. It should be understood that the positioning of combination 66 could be reversed 180 degrees, if so desired.

Focusing now on FIG. 6*b,* combination 66 is labeled 66*b* since it illustrates same in a free floating, intermediate position B. The position shown in FIG. 6*b* corresponds to position B shown in FIGS. 2 and 8, in which rod extension pin member 50 is permitted to float, via the partial stroking of piston rod 18, thereby permitting rod extension pin 50 of LMD 10 to "float" within land-locked slots 42, between slot ends 42 and 46, without hydraulic forces acting on implement 70, so that implement 70 can conform or adjust to undulations 90 or, alternatively, non-smooth transitions in ground level 88.

Advancing now to FIG. 6*c,* combination 66 is now labeled 66*c* since it illustrates same in a fully extended position C. The position shown in FIG. 6*c* corresponds to the position C shown in FIGS. 3 and 9, in which rod extension pin member 50 substantially abuts outer end 46 of sleeve member land-locked slots 42, thereby permitting hydraulic forces to act on implement 70 in the direction of the arrow shown in FIG. 9. It should be understood that the degree or amount, of to the vertical movement or "float" of implement 70 is determined and limited by the length of axial slot(s) 42. Thus, with reference to intermediate position B (FIG. 8), pin member(s) 50, while being illustrated as being located at about the mid-point of the length of slots(s) 42, could range from being near outer slot end 46, thus permitting very limited floating, being located adjoining or even abutting inner slot end 44, thus providing maximum float capability.

Figure 8:
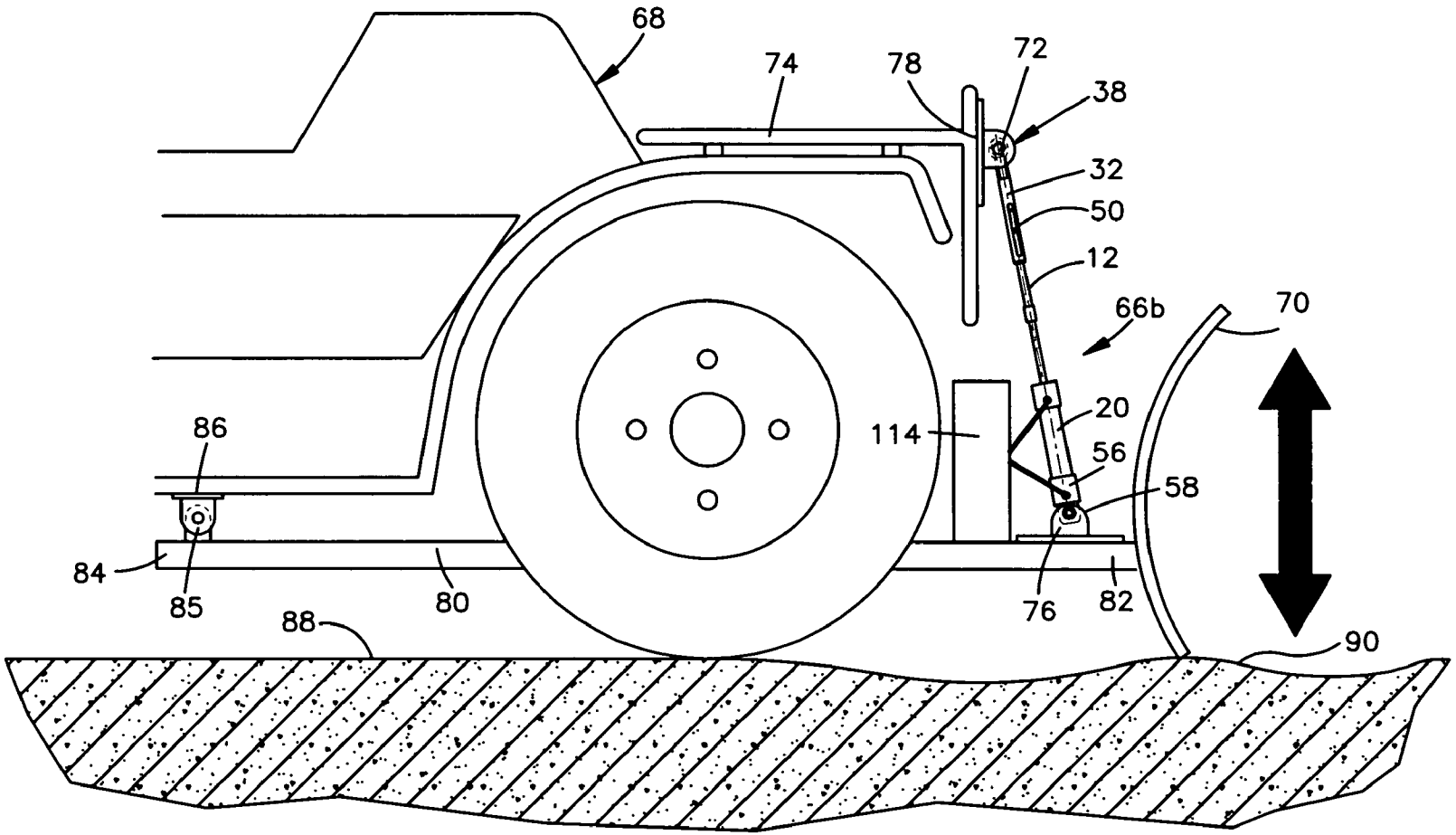
FIG. 8 is a view similar to that of FIG. 7, but showing same in a free floating, intermediate, position B.
Figure 9:
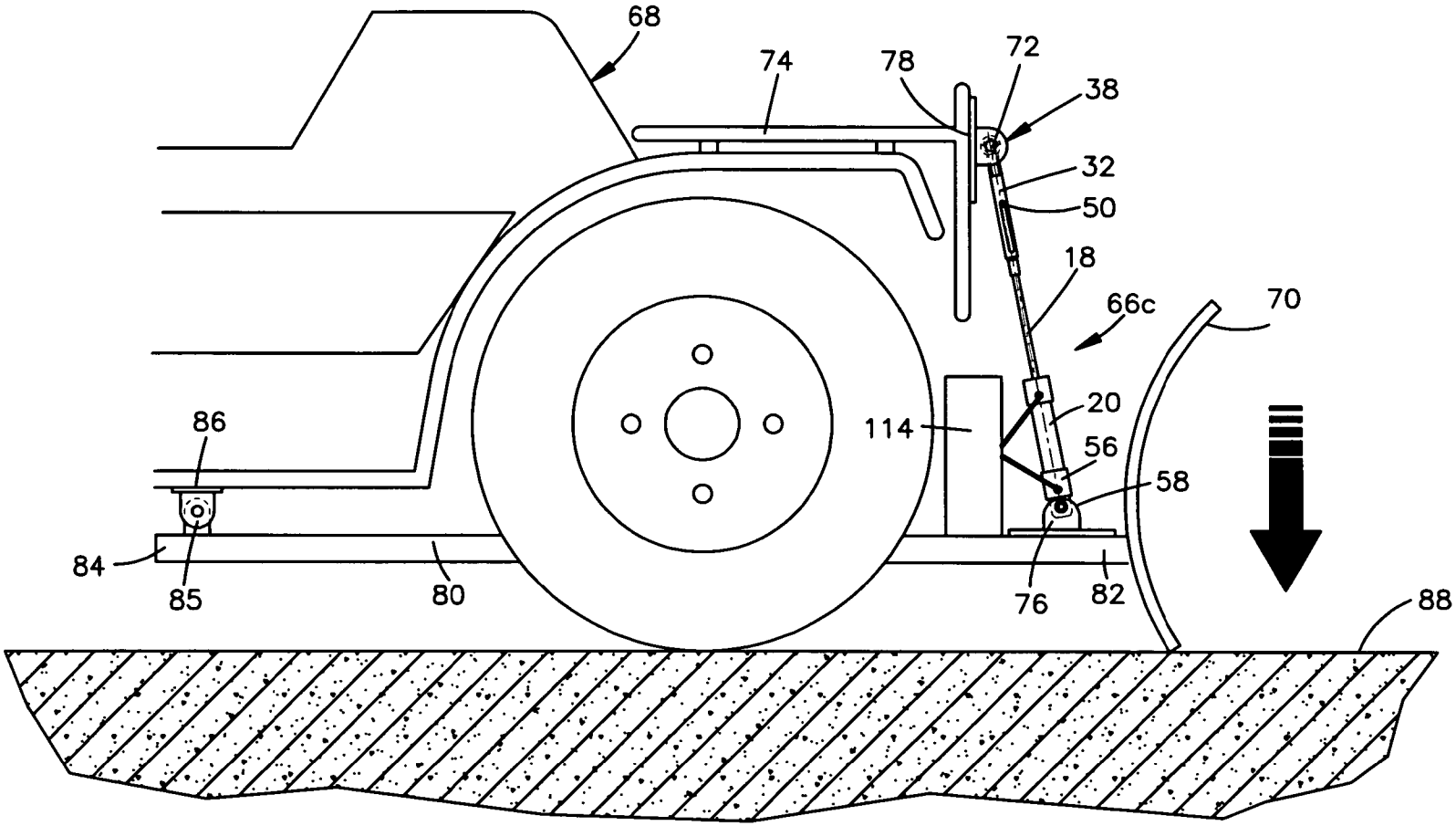
FIG. 9 is a view, again similar to that of FIG. 7, but showing same in a fully extended position C.

To reiterate, in terms of FIGS. 7-9 there is illustrated a schematic side view of vehicle 68 and its pivotally mounted implement 70, wherein LMD 10 is shown progressively in its fully extended position A in FIG. 7; in its free floating, intermediate position B in FIG. 8; and in its fully retracted position C in FIG. 9.

Figure 11:
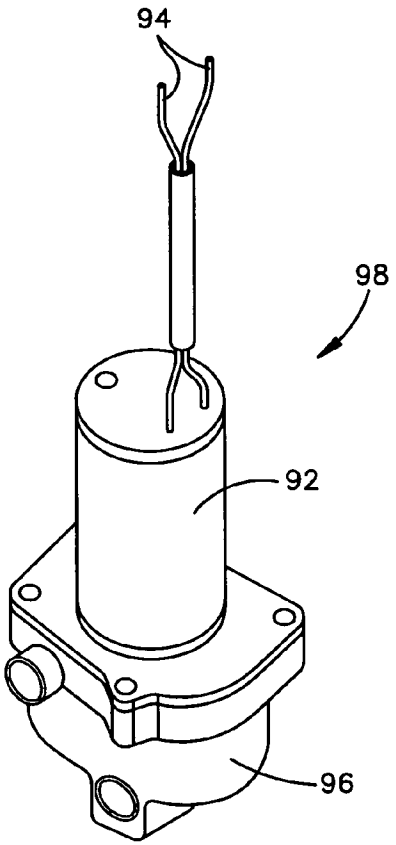
FIG. 11 is a perspective view of a known DC electric motor and hydraulic pump arrangement used for powering the circuit shown in the hydraulic schematic of FIG. 10.
Figure 10:
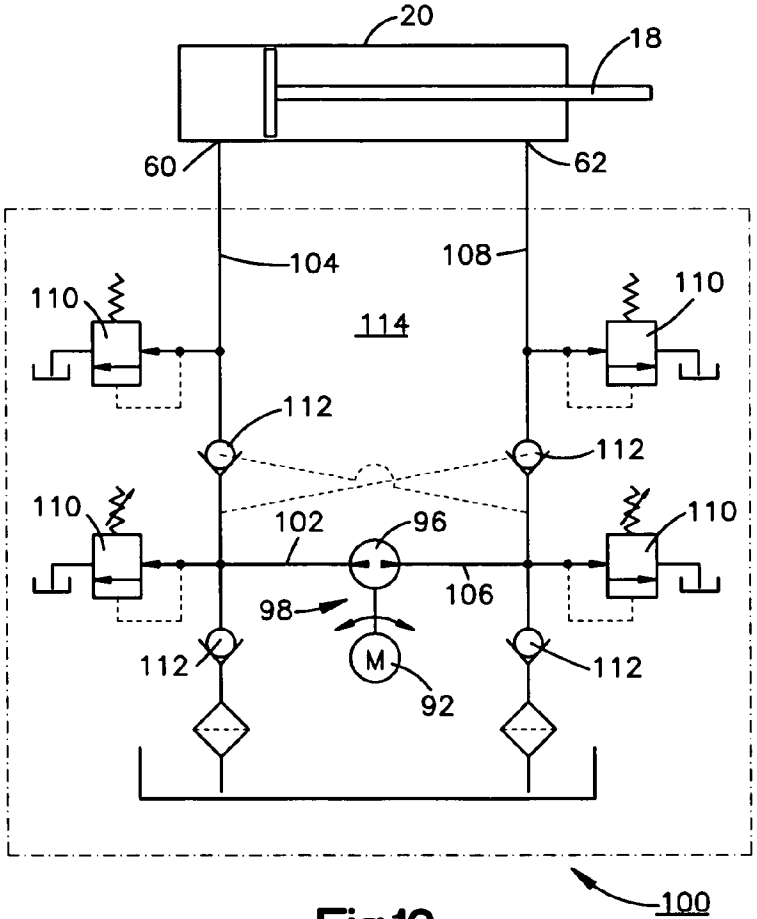
FIG. 10 is a simplified hydraulic schematic of the hydraulic power unit system for pivoting the implement.

Advancing to FIG. 11, illustrated therein is a combination or power unit 98 utilizing a known, preferably 12 volt D.C. bi-directionally rotatable, reversible, rotating electric motor 92, having electrical lead-ins 94 operatively interconnected with a known fixed displacement hydraulic gear pump 96, with commercial power units 98 of this type being available from the Oildyne Division of the Parker Hannifin Corporation of Cleveland, Ohio, United States of America. Power unit 98, within a hydraulic circuit 100 (FIG. 10), is preferably located, for example on implement support frame 80, and is operatively interconnected in a known manner with hydraulic cylinder 20 and LMD 10, as schematically shown in FIGS. 7-9, so as to permit "floating" thereof with implement 70.

Returning now to FIG. 10 illustrated therein is a simplified hydraulic schematic 100 showing power unit 98, comprised of interconnected electric motor 92 and hydraulic gear pump 96, operate in unison in a bi-directional, reversible, modes for alternately pumping pressurized hydraulic fluid into hydraulic cylinder port 60, via interconnected conduits 102 and 104 for powering cylinder piston rod 18 outwardly from cylinder 20 and alternately into hydraulic cylinder port 62, via interconnected conduits 106 and 108, for retracting piston rod 18 back into cylinder 20 in a manner well known in the art. Multiple known relief valves 110 and multiple check valves 112 serve to protect the individual conduits and together with the usual filters and reservoirs complete this conventional hydraulic circuit 114. Further known cab-mounted controls permit operator control, preferably via a conventional hand-operated controller.

In one embodiment, the present invention can be defined as an apparatus for pivoting on a vehicle 68, a front-end mounted implement 70, relative to ground level 88 or 90, utilizing a fluid-pressurized, double-acting hydraulic cylinder 20 with the latter being connected on one cylinder end to either vehicle 68 or implement 70, wherein cylinder 20 includes an output member 18, the outer end of which is rotatably connected to either implement 70 or vehicle 68 with the improvement comprising the operative interpositioning of LMD 10 between the output member outer end and either vehicle 68 or implement 70, thereby permitting not only the full lowering of implement 70 while remaining under full hydraulic pressure as well as full raising of implement 70, both via hydraulic pressure, but additionally permitting full lowering of implement 70, relative to ground level 88 and/or 90, in a floating condition without hydraulic forces acting thereon.

The present invention also includes a method for pivoting implement 70 and reference should be made to FIGS. 7-9 for the full understanding thereof. Specifically, this method includes the steps of: fully stroking piston rod 18, and thus LMD 10 from a retracted rest position A (FIG. 7), in an outward direction, causing LMD 10 to be fully extended and resulting implement 70 to be both fully lowered to position C (FIG. 9), relative to ground level 88, while remaining under full hydraulic pressure; partially stroking piston rod 18 from either fully retracted rest position A (FIG. 7) or from fully extended outward position C (FIG. 9), causing LMD 10 to be operative and resulting in implement 70 to be either fully lowered to position B (FIG. 8) or remaining fully lowered, relative to ground level (FIG. 8, position B), in a floating position without hydraulic forces acting thereon; and either partially stroking piston rod 18 in an inward direction when implement 70 is in floating position B (FIG. 8) or fully stroking piston rod 18 in an inward direction when implement 70 is in fully lowered position C (FIG. 9), causing LMD 10 to be fully retracted when piston rod 18 reaches retracted rest position A (FIG. 7), thus resulting in implement 70 to be fully raised, relative to ground level 88 or 90.

The unique design, as well as the structural and operational attributes of the present invention, specifically the use of LMD 10, allow the implement operator to not only to raise and lower the implement 70, but also provides the capabilities of both free-floating and hydraulic down force functions, in the manner previously described. For ease of description and understanding, the word "implement" is used here in a generic sense and is deemed to include all types of mechanisms that are adaptable to being movably mounted relative to the front end of any type of vehicle e.g., such as an ATV (All Terrain Vehicle), and can include but are not limited to devices such as plowing blades for snow or dirt, as well as rotating brushes, rakes, scrapers, aerators and the like.

It is deemed that one of ordinary skill in the art will readily recognize that the present invention fills remaining needs in this art and will be able to effect various changes, substitutions of equivalents and various other aspects of the invention as described herein. Thus, it is intended that the protection granted hereon be limited only by the scope of the appended claims and their equivalents.

What is claimed is:

1. A lost motion mechanism operatively interconnected with a hydraulic cylinder, said hydraulic cylinder being rotatably connected to one of a vehicle and an implement, said lost motion mechanism being rotatably connected to the other of said vehicle and said implement, said cylinder and lost motion mechanism cooperating for moving said implement relative to a ground level, said lost motion mechanism comprising in combination:

an elongated rod connected with a portion of said hydraulic cylinder;

an elongated sleeve member adapted to receive at least a portion of said rod extension, said sleeve member including at least one slot of a predetermined length; and at least one pin member attached relative to said rod extension and protruding into said at least one slot, said at least one pin member being free to move within said at least one slot to enable free movement of said rod extension relative to said elongated sleeve member, said pin member together with said slot, limiting the longitudinal movement of said rod extension and enabling the implement to be moved by hydraulic force both upward and downward relative to the ground level as well as enabling the implement to be free floating relative to the ground level.

2. The lost motion mechanism of claim 1 wherein said sleeve member includes at least two slots, said at least one pin member extending into each slot.

3. The lost motion mechanism of claim 2 wherein said slots are equally spaced about a circumference of said sleeve member.

4. The lost motion mechanism of claim 1 wherein the degree of floating movement of said implement is determined by a length of said slot.

5. The lost motion mechanism of claim 1 wherein said rotatable connections are achieved via clevis coupling members.

6. The lost motion mechanism of claim 1 wherein said implement takes the form of a snow plow.

7. In an apparatus for moving, relative to ground level, of an implement of a vehicle, utilizing a hydraulic cylinder, said hydraulic cylinder being rotatably connected to one of said vehicle and said implement, the improvement comprising a lost motion mechanism interposed between said hydraulic cylinder and the other of said vehicle and said implement, said lost motion mechanism enabling lowering of the implement under full hydraulic pressure as well as full raising of said implement, said lost motion mechanism additionally permitting full lowering of said implement, relative to said ground level, in a free floating condition without hydraulic forces acting thereon, wherein said lost motion device comprises:

an elongated extension connected with said hydraulic cylinder;

an elongated sleeve member adapted to receive, at least a portion of said elongated extension in a sliding fit manner, said sleeve member including at least one axially-extending slot of a predetermined length; and at least one pin member attached to and extending from said elongated extension into said at least one slot, said at least one pin member being free to move within said at least one axially extending slot to enable free movement of said elongated extension relative to said elongated sleeve member, said pin member together with said slot, limiting the longitudinal sliding movement of said elongated extension and enabling the floating movement of said implement.

8. The apparatus of claim 7 wherein said elongated sleeve member includes at least two slots and said at least one member extends into each slot.

9. The apparatus of claim 8 wherein said slots are equally spaced about a circumference of the sleeve member.

10. The apparatus of claim 7 wherein the degree of floating movement is determined by the length of the said slot.

11. The apparatus of claim 7 wherein said rotatable connections are achieved via clevis couplings.

12. The apparatus of claim 7 wherein said implement takes the form of a snow plow.

13. In an apparatus for moving, relative to ground level, of a front-end mounted snow plow on a vehicle, utilizing a fluid power cylinder, said cylinder being rotatably connected to one of said vehicle and said snow plow, the improvement comprising a mechanical lost motion mechanism interposed between said cylinder and other of said vehicle and said snow plow, said lost motion mechanism permitting full lowering of said snow plow, relative to said ground level, in a free floating condition without fluid power forces acting thereon, wherein said mechanical lost motion mechanism includes:

an elongated rod extension affixed to said cylinder;

an elongated sleeve member having circumferentially opposed, axially-extending slots of a predetermined length and being adapted to receive in sliding-fit fashion, a portion of said rod extension; and opposed pin members radiating from said rod extension and protruding into said opposed slots, said opposed pin members being free to move within said opposed slots to enable free movement of said rod extension relative to said elongated sleeve member, said opposed pin members and said opposed slots limiting the sliding movement of said rod extension within said sleeve member and the accompanying floating movement of said snow plow.

14. The apparatus of claim 13 wherein the degree of floating movement said snow plow is determined by the length of said slots.

15. The apparatus of claim 13 wherein said snow plow is affixed to a support frame, with said support frame being pivotally connected with said vehicle.

16. The apparatus of claim 15 further including a source of pressurized fluid operatively interconnected with said fluid power cylinder.

17. The apparatus of claim 16 wherein said source of pressurized fluid is also affixed to said support frame.

* * * * *